US008628632B2

(12) United States Patent
Sternau

(10) Patent No.: US 8,628,632 B2
(45) Date of Patent: Jan. 14, 2014

(54) VAPOR BARRIER TAPE DISPENSER

(76) Inventor: Daniel J. Sternau, Belleville, IL (US)

( * ) Notice: Subject to any disclaimer, the term of this patent is extended or adjusted under 35 U.S.C. 154(b) by 163 days.

(21) Appl. No.: 13/165,521

(22) Filed: Jun. 21, 2011

(65) Prior Publication Data

US 2011/0308708 A1 Dec. 22, 2011

Related U.S. Application Data

(60) Provisional application No. 61/356,878, filed on Jun. 21, 2010.

(51) Int. Cl.
*E04F 21/00* (2006.01)

(52) U.S. Cl.
USPC ..... 156/71; 156/577; 156/579

(58) Field of Classification Search
USPC ..... 156/71, 574, 577, 579
See application file for complete search history.

(56) References Cited

U.S. PATENT DOCUMENTS

| | | | | |
|---|---|---|---|---|
| 4,277,034 | A * | 7/1981 | Buzzell | 242/417.3 |
| 4,460,433 | A * | 7/1984 | Boyd | 156/574 |
| 4,923,559 | A * | 5/1990 | Kennedy et al. | 156/523 |
| 2001/0052395 | A1 * | 12/2001 | Zupon et al. | 156/575 |
| 2002/0029859 | A1 * | 3/2002 | Weaver | 156/577 |
| 2004/0129387 | A1 * | 7/2004 | Ibrahim et al. | 156/577 |
| 2004/0200559 | A1 * | 10/2004 | Richards et al. | 156/71 |
| 2005/0028941 | A1 * | 2/2005 | Flowers | 156/574 |
| 2006/0065346 | A1 * | 3/2006 | Skoczylas | 156/71 |

* cited by examiner

*Primary Examiner* — Mark A Osele
(74) *Attorney, Agent, or Firm* — Polster, Lieder, Woodruff & Lucchesi, L.C.

(57) ABSTRACT

A vapor barrier tape dispenser includes a generally upright frame. A roller pivotally mounts to a lower portion of the frame. A handle mounts to an upper portion of the frame for engagement by an operator. A spindle pivotally mounts to the frame. A tape roll pivotally attaches to the spindle and is configured to feed a strip of tape around a portion of the roller for adherence to a vapor barrier.

5 Claims, 1 Drawing Sheet

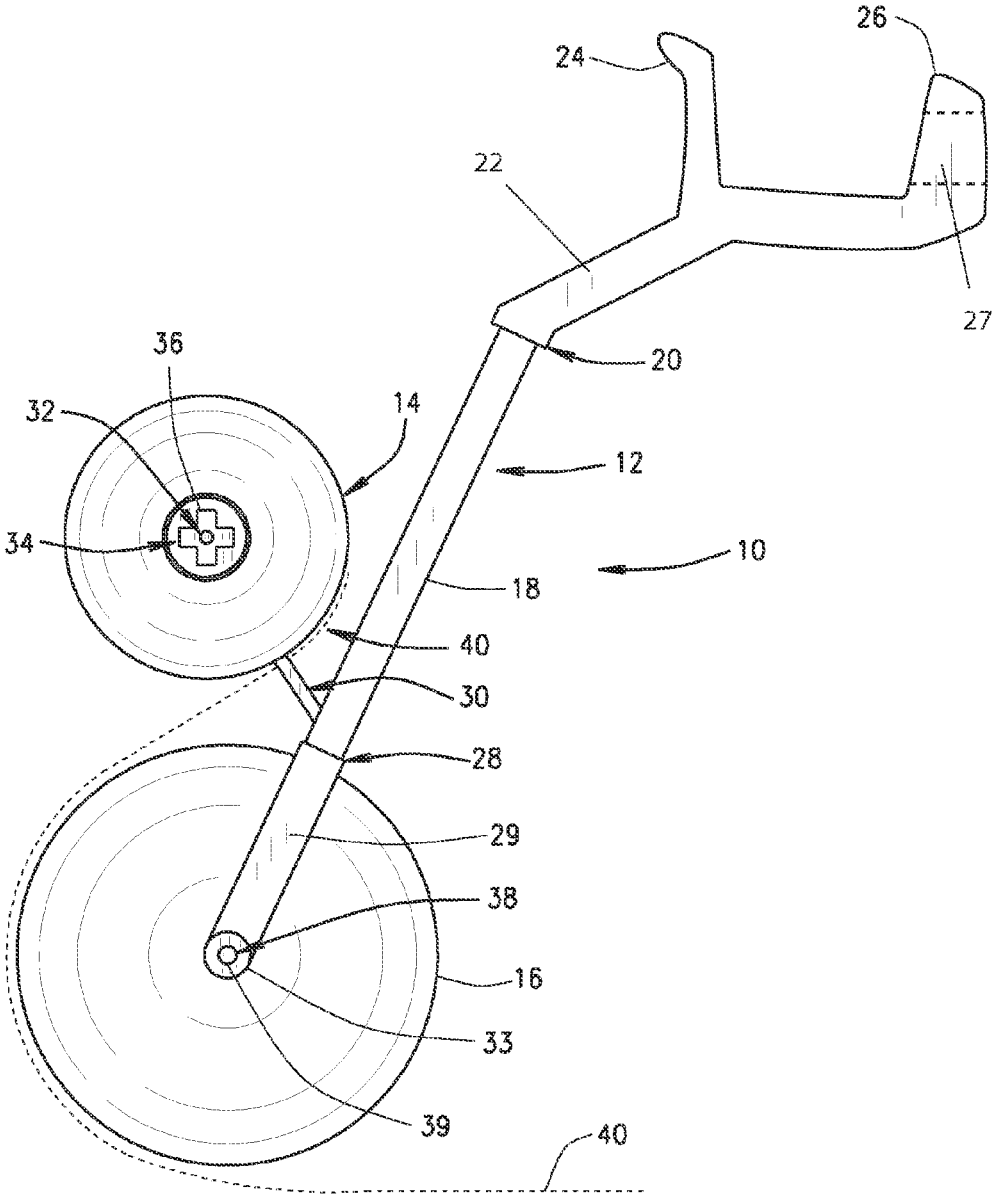
26
24
22
27
20
36
32
14
12
34
10
18
40
30
28
29
38
16
33
39
40

VAPOR BARRIER TAPE DISPENSER

CROSS-REFERENCE TO RELATED APPLICATIONS

This Non-Provisional application claims priority to United States Provisional Application Ser. No. 61/356,878 filed Jun. 21, 2010, and which is incorporated herein by reference.

STATEMENT REGARDING FEDERALLY SPONSORED RESEARCH

Not Applicable.

BACKGROUND

A vapor barrier or vapor diffusion retarder is widely used in both commercial and the residential construction markets. Typically, the vapor barrier is installed in concrete slabs, basements, ceilings, walls, or floors to stop the transmission of moisture, moisture vapor, radon gas, and other contaminants into buildings. For obvious health reasons, occupants do not want these contaminants entering through the floor.

For example, to install in a floor or concrete slab, the vapor barrier is generally rolled out in sections onto the subgrade and connected together along the seams with a tape adhesive. Normally, two workers manually roll the tape out in manageable sections along on the seams of the vapor barrier sections, which requires the workers to spend long periods of time in uncomfortable and unhealthy positions, such as squatting or bent over. In addition, the large amount of labor and time involved makes installation of the tape uneconomical. Once all the seams are adhered together and any penetrations are sealed with similar products, concrete is poured directly onto the vapor barrier to form a concrete slab. The vapor barrier acts as a membrane break between the subgrade and the porous underside of the concrete slab.

Therefore, there is a long felt need for a method and device for dispensing and installing tape onto the seams of a vapor barrier.

DESCRIPTION OF THE DRAWING

In the accompanying drawing which form part of the specification:

FIG. 1 is a side view of a Vapor Barrier Tape Dispenser.

Corresponding reference numerals indicate corresponding parts throughout the FIGURE of the drawing.

DETAILED DESCRIPTION

The following detailed description illustrates the claimed invention by way of example and not by way of limitation. The description clearly enables one skilled in the art to make and use the disclosure, describes several embodiments, adaptations, variations, alternatives, and uses of the disclosure, including what is presently believed to be the best mode of carrying out the claimed invention. Additionally, it is to be understood that the disclosure is not limited in its application to the details of construction and the arrangements of components set forth in the following description or illustrated in the drawing. The disclosure is capable of other embodiments and of being practiced or being carried out in various ways. Also, it is to be understood that the phraseology and terminology used herein is for the purpose of description and should not be regarded as limiting.

As shown in FIG. 1, an embodiment generally referred to as a vapor barrier tape dispenser 10, includes a generally upright frame 12 configured for pivotal support of a tape roll 14, and a roller 16 for application of the tape roll 14 to a vapor barrier.

The frame 12 includes a generally linear rod 18 with an upper portion 20 sized and shaped for engagement by an operator. The upper portion 20 defines an angled section 22 that extends from the rod 18 to connect to a handle 24 and an arm brace 26. The handle 24 extends generally vertically and is sized and shaped for engagement by the operator. The arm brace 26 is generally hoop-shaped with an opening 27 and is positioned generally rearward of the handle 24. The opening 27 is sized and shaped to allow an operator to insert his or her arms and hands through the opening 27 to engage the handle 24, while the arm brace 26 engages the operator's arms. The handle 24 allows the operator to control and direct the tape dispenser 10. The arm brace 26 enhances stabilization of the tape dispenser 10 during use.

The frame 12 also includes a lower portion 28 sized and shaped to pivotally attach to the roller 16. The lower portion is a bracket 29 with a pair of arms that extend outwardly to pivotally attach to respective ends of the roller 16, such as with fasteners 39 and bearings. A support arm 30 extends generally outwardly from the linear rod 18 to pivotally attach to a spindle 32, which is shaped and sized to engage the tape roll 14. As shown in FIG. 1, the spindle 32 has a generally X-shaped cross-section. However, any suitable size or shaped spindle can be used to engage the tape roll 14. The frame 10 is preferably made from a strong lightweight material, such as aluminum. However, any suitable material can be used, including, but not limited to, metal, wood, or plastic. Also, the frame 12 is preferably of unitary construction, but it can also be assembled with multiple portions.

An generally cylindrical insert 34 is sized and shaped for insertion into a bore of the tape roll 14, such as with a friction fit. A bore 36 of the insert 34 is generally X-shaped to correspond to the shape of the spindle 32. In this way, the insert 34 mates the tape roll 14 to the spindle 32. The X-shape enhances the connection between the spindle 32 and insert 34 to prevent slippage during operation.

The roller 16 is generally cylindrical with connection points 38 at each end along the center axis for pivotal connection to the brackets 29 of the frame 10, such as with fasteners 39. The roller 16 includes a spindle 33 along the center axis to permit free rotation of the roller about the center axis. Alternatively, the roller 16 can use bearings, bushings, or any combination thereof, and any other suitable means for rotation. The size of the roller 16 is preferably about 8" in diameter and about 12" in width. However, any diameter and width can be used.

In operation, the insert 34 is placed inside the bore of the tape roll 14. The tape roll 14 with insert 34 is mounted on the spindle 32. The operator pulls a strip of tape 40 from the tape roll 14 in a counterclockwise direction (as shown in FIG. 1). The strip of tape 40 wraps about a portion of the roller 16 with the non-adhesive side against the roller 16 and the adhesive side facing outwardly from the roller 16. The strip of tape 40 adheres along the seams of two vapor barrier sections. The operator inserts his or her hands through the opening 28 of the arm brace 26 and engages the handle 24. As the operator pushes the tape dispenser 10 forward the roller 16 pulls the strip of tape 40 from the tape roll 14 to continuously adhere the strip of tape 40 with the vapor barrier sections. The angle of the upper portion 20 aids the operator in applying a downward force on the roller 16. In this way, the operator can apply the tape roll 14 to the vapor barrier sections while comfortably standing and pushing the tape dispenser 10.

Changes can be made in the above constructions without departing from the scope of the disclosure, it is intended that all matter contained in the above description or shown in the accompanying drawing shall be interpreted as illustrative and not in a limiting sense.

What is claimed is:

1. A vapor barrier tape dispenser, comprising:

a generally upright frame;

a roller rotationally mounted to a lower portion of the frame;

a handle mounted to an upper portion of the frame being sized and shaped for engagement by an operator's hands;

a spindle rotationally mounted to the frame;

a tape roll removeably attached to the spindle, the tape roll configured to feed a strip of tape around a portion of the roller for adherence to a vapor barrier; and a generally hoop-shaped brace defining an opening sized and shaped to receive the operator's arms, the brace being positioned generally rearward to the handle at a predetermined distance for engagement of the operator's arms.

2. The vapor barrier tape dispenser of claim 1, further comprising:

a generally cylindrical insert shaped and sized for engagement with a bore of the tape roll, the insert defining a generally x-shaped bore; and wherein the spindle defines a generally x-shaped cross-section sized and shaped for engagement with the x-shaped bore of the insert.

3. A vapor barrier tape dispenser, comprising:

a generally upright frame;

a roller rotationally mounted to a lower portion of the frame;

a handle mounted to an upper portion of the frame being sized and shaped for engagement by an operator's hands;

a generally hoop-shaped brace defining an opening sized and shaped to receive the operator's arms, the brace being positioned generally rearward to the handle at a predetermined distance for engagement of the operator's arms;

a spindle rotationally mounted to the frame;

a tape roll removeably attached to the spindle, the tape roll configured to feed a strip of tape around a portion of the roller for adherence to a vapor barrier;

a generally cylindrical insert shaped and sized for engagement with a bore of the tape roll, the insert defining a generally x-shaped bore; and wherein the spindle defines a generally x-shaped cross-section sized and shaped for engagement with the x-shaped bore of the insert.

4. A method of applying tape to a vapor barrier, comprising the steps of:

providing a generally upright frame;

providing a roller rotationally mounted to a lower portion of the frame;

providing a handle mounted to an upper portion of the frame;

providing a spindle rotationally mounted to the frame; and providing a tape roll removeably attached to the spindle, abutting respective edges of a pair of vapor barrier sections to form a seam;

feeding a strip of tape around a portion of the roller for adherence to a vapor barrier;

advancing the roller along the seam; and adhering the strip of tape along the seam as the roller advances; and providing a generally hoop-shaped brace defining an opening sized and shaped to receive the operator's arms, the brace being positioned generally rearward to the handle at a predetermined distance for engagement of the operator's arms.

5. The method of claim 4, further comprising the steps of:

providing a generally cylindrical insert shaped and sized for engagement with a bore of the tape roll, the insert defining a generally x-shaped bore; and wherein the spindle defines a generally x-shaped cross-section sized and shaped for engagement with the x-shaped bore of the insert.

* * * * *